US006640705B1

(12) United States Patent
Stuhlmiller et al.

(10) Patent No.: US 6,640,705 B1
(45) Date of Patent: Nov. 4, 2003

(54) ROTARY PRINTING MACHINE WITH A PLATE CYLINDER, A TRANSFER CYLINDER AND AN IMPRESSION CYLINDER

(75) Inventors: Helmut Stuhlmiller, Altenmünster (DE); Reinhard Zeller, Augsburg (DE); Eduard Hoffman, Bobingen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/568,432

(22) Filed: May 10, 2000

(30) Foreign Application Priority Data

May 10, 1999 (DE) ..... 199 21 388

(51) Int. Cl.[7] ..... B41F 7/02
(52) U.S. Cl. ..... 101/217; 101/375
(58) Field of Search ..... 101/217, 375, 101/376, 401.1, 492, 493; 492/18, 48; 428/909

(56) References Cited

U.S. PATENT DOCUMENTS 4,599,943 A * 7/1986 Kobler ..... 101/217
5,440,981 A * 8/1995 Vrotacoe et al. ..... 101/217
5,813,334 A * 9/1998 Blanchard ..... 101/217
6,148,726 A * 11/2000 Harada ..... 101/217

FOREIGN PATENT DOCUMENTS

| | | | |
|---|---|---|---|
| DE | 196 19 655 | 2/1997 | ..... B41N/10/00 |
| DE | 196 10 949 | 9/1997 | |
| DE | 196 34 033 | 3/1998 | |
| DE | 197 20 551 | 11/1998 | |
| EP | 0 421 145 | 9/1990 | ..... B41N/10/00 |
| EP | 0 697 284 | 5/1995 | |
| GB | 606888 | 2/1946 | |

* cited by examiner

*Primary Examiner*—Ren Yan
(74) *Attorney, Agent, or Firm*—Cohen, Pontani, Lieberman & Pavane

(57) ABSTRACT

The most uniform possible temperature variation along the circumference of a transfer cylinder in a rotary printing machine is achieved by arranging a highly thermally layer made of a material having a thermal conductivity significantly higher than steel under a rubber blanket on the transfer cylinder for distributing heat from the rubber blanket along the direction of the surface of the transfer cylinder. The highly conductive layer is arranged on a support of the rubber blanket.

3 Claims, 3 Drawing Sheets

ROTARY PRINTING MACHINE WITH A PLATE CYLINDER, A TRANSFER CYLINDER AND AN IMPRESSION CYLINDER

BACKGROUND OF THE INVENTION

1. Field of the Invention

The invention relates to a rotary printing machine with a plate cylinder, a transfer cylinder and an impression cylinder, wherein the transfer cylinder has a rubber blanket arranged on a support. Rotary printing machines of this type operate in accordance with an indirect printing process such as an offset printing process or an indirect gravure printing process.

2. Description of the Related Art

During operation of a rotary printing machine with a plate cylinder, a transfer cylinder and an impression cylinder, the plate cylinder presses onto the transfer cylinder and the transfer cylinder is pressed against the impression cylinder with a web running between the transfer cylinder and the impression cylinder. The rubber blanket on the transfer cylinder is compressed by the plate cylinder and the impression cylinder producing a flexure work of the rubber blanket. As a result of the flexure work, dissipation energy is produced in the rubber blanket of the transfer cylinder during rolling contact with a plate cylinder and the impression cylinder. The dissipation energy produces an undesired heating of the rubber blanket. One solution for removing the undesired heating is to incorporate and an internal cooling system for the transfer cylinder as disclosed, for example, in accordance with European Patent No. EP 0 697 284 A1. However, both the production and the operation of this type of internal cooling is complicated thereby adding significantly to manufacturing and operating costs.

Another solution described in German reference DE 196 19 655 A1 improves the heat transfer between the rubber blanket and the transfer cylinder on which the rubber blanket is mounted to comply with prescribed temperatures of a rubber blanket. It is proposed that the rubber blanket contain a heat-dissipating inlay or underlay, which leads the heat away better radially toward the transfer cylinder. A problem with this solution is that local heating differences in the rubber blanket heat the transfer cylinder to a correspondingly different extent. The local temperature differences of this kind in the rubber blanket may be caused by the subject matter being printed or may be established as a result of different compressibility of the rubber blanket, for example as a result of inhomogeneities in the rubber blanket. The nonuniform heating of the transfer cylinder may in turn lead to deformations such as, for example, a curvature of the longitudinal axis of the transfer cylinder which disrupt the ink transfer and impair the printing quality.

SUMMARY OF THE INVENTION

The object of the present invention is to provide a rotary printing machine with a transfer cylinder that minimizes the temperature variation around the circumference so that the temperature is as uniform as possible over the circumference of the transfer cylinder.

The object of the present invention is achieved by a rotary printing machine, comprising a plate cylinder, a transfer cylinder and an impression cylinder. The transfer cylinder is arranged between the plate cylinder and the impression cylinder for transferring an image to a web passing between the transfer cylinder and the impression cylinder. The transfer cylinder comprises a rubber blanket arranged on a support with a highly thermally conductive layer arranged between the rubber blanket and the support for distributing localized heat from the rubber blanket along a surface of the transfer cylinder. The highly conductive layer comprises a material having a thermal conductivity (a) substantially higher than the thermal conductivity of steel.

The highly thermally conductive layer arranged beneath the rubber blanket distributes heat differences in the direction of the surface of the transfer cylinder (i.e., in the longitudinal and circumferential directions), and thus contributes to making the temperature of the transfer cylinder more uniform in these directions. Inevitably, the highly thermally conductive layer will also conduct heat to the transfer cylinder, but this is typically an insignificant portion. If necessary, the radial heat conduction toward the transfer cylinder may optionally be counteracted by providing a thermally insulating layer. Accordingly, the thermally conductive layer of the present invention counteracts nonuniform heating of the transfer cylinder and the bulging of the transfer cylinder associated with nonuniform heating, thereby providing the proper preconditions for a good printing quality (good impression). In addition, the thermally conductive layer on the rubber-blanket support may be produced cost-effectively.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
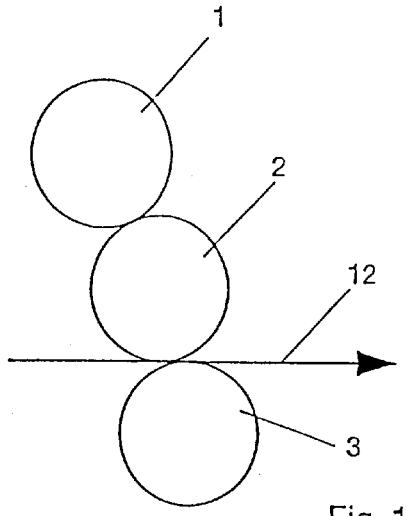
FIG. 1 is a side view showing the printing unit cylinders of a rotary printing machine.

FIG. 1 schematically illustrates a side view of an arrangement of printing unit cylinders in a printing unit of a rotary printing machine. The arrangement of printing unit cylinders comprises a plate cylinder 1, a transfer cylinder 2 and an impression cylinder 3. Of course, the impression cylinder 3 may also be designed as a transfer cylinder of a further printing unit. A web 12 running between the transfer cylinder 2 and the impression cylinder 3 may be printed. A sleeve 4 shown in FIGS. 4 and 4*a* may be pushed on the transfer cylinder 2. The sleeve 4 comprises a supporting sleeve 5 which preferably consists of nickel and has a thickness of approximately 0.1 to 0.25 mm. Alternatively, the supporting sleeve 5 may comprise a polymer such as, for example, a carbon fiber reinforced polyester (CFRP). A highly thermally conductive layer 6 of copper is arranged on the outer circumferential surface of the supporting sleeve 5. The highly thermally conductive layer 6 also has a thickness of approximately 0.1 to 0.25 mm. The rubber blanket 7 is fixed to the highly thermally conductive layer 6. In the exemplary embodiment, the rubber blanket 7 is vulcanized on endlessly. However, the rubber blanket 7 may also comprise a plate adhesively bonded onto the highly thermally conductive layer 6 with a butt joint, and therefore finite. In addition, it goes without saying that the rubber blanket 7 in this and the further exemplary embodiments may comprise a rubber-like polymer.

Figure 4:
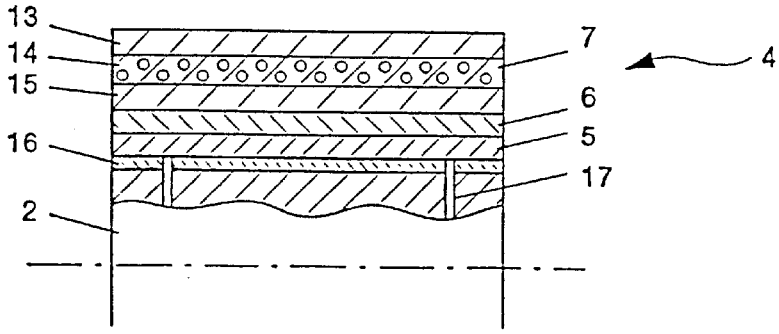
FIG. 4 is a longitudinal sectional view of a transfer cylinder having a sleeve-like rubber blanket with a supporting sleeve having a copper layer according to the present invention.

The rubber blanket 7 shown in FIG. 4 includes multiple layers comprising, for example, a compressible layer 14 and a further layer 15 under a top layer 13. The present invention may be employed in all known rubber-covered or transfer cylinder sleeves. Furthermore, one or more layers or fabric inlays of non-expansible material such as, for example, yarn may be provided between the upper layer 13 and compressible 14, in the compressible layer 14, and/or between the compressible layer 14 and the further layer 15. Rubber layers of this type are shown, for example, in European reference EP 0 421 145 B1. The plate cylinder 1 may also be configured with a conventional clamping channel to accommodate the legs of finite plates, or to provide a plate sleeve on the cylinder. Furthermore, a thermally insulating layer 16 such as, for example, an Astralon layer may optionally be arranged between the transfer cylinder 2 and the supporting sleeve 5. The thermally insulating layer 16 may be bonded to the transfer cylinder 2 via an adhesive bond. The thermally insulating layer 16 prevents the conduction of heat being output from the supporting sleeve 5 to the transfer cylinder 2. Furthermore, blow holes 17 may be aranged on the transfer cylinder which penetrate the surface of the transfer cylinder 2, thereby allowing compressed air to be blown underneath the supporting sleeve 5. The arrangement of blow holes 17 allow the supporting sleeve 5 to expand elastically and be pushed onto and off the transfer cylinder 2. The thermally insulating layer 16 can also be arranged in other ways under the rubber blankets 7 to prevent any heat transfer to the transfer cylinder 2.

Figure 2:
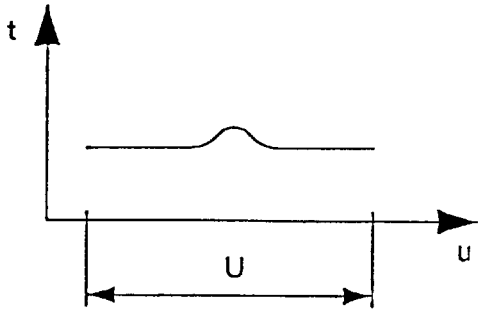
FIG. 2 is a graph with a temperature variation along a circumference of a transfer cylinder with a conventional rubber-blanket support.
Figure 3:
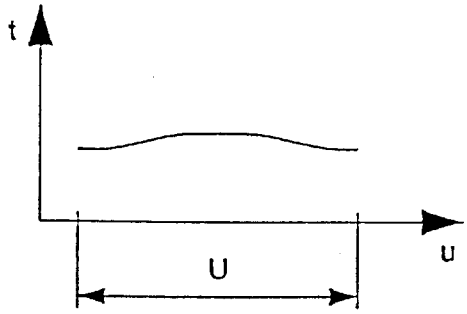
FIG. 3 is a graph with a temperature variation along a circumference of a transfer cylinder with a rubber-blanket support with a thermally conductive layer according to an embodiment of the present invention.

FIGS. 2 and 3 show graphs of the temperature t of the rubber blanket in the direction u around the circumference of a transfer cylinder. Each graph shows a plot of a circumference U of the transfer cylinder. FIG. 2 is a plot of the temperature around a circumference of a conventional transfer cylinder that does not have a highly thermally conductive layer with a high thermal conductivity (i.e., a conventional rubber-blanket support) on the support (supporting sleeve 5) of the rubber blanket 7. Accordingly, the plot of temperature shows an abrupt increase in temperature recorded in a region where the rubber blanket 7 is subjected to increased flexure work. The increased flexure work may be caused by the characteristics of the subject matter being printed or because of an inhomogeneity in the rubber blanket. FIG. 3 shows the temperature variation around a circumference of a transfer cylinder 2 according to the present invention using the same rubber blanket 7, the transfer cylinder 2 having a highly thermally conductive layer 6 made of copper. The thermally conductive layer 6 made of copper has a thermal conductivity of $a \approx 113 \times 10^6$ $m^2/s$, as compared with $a \approx 14 \times 10^6$ $m^2/s$ of steel or nickel. The significantly higher thermal conductivity a of the layer 6 allows the dissipation energy (heat) developed locally in the rubber blanket 7 to be conducted rapidly in the longitudinal direction and the circumferential direction u. As a result, the heating over the circumference U is more uniform and is also no longer so high. The transfer cylinder 2 is also heated correspondingly more uniformly over the circumference, thereby avoiding deformations which would otherwise be established. Instead of copper, the highly thermally conductive layer 6 may also comprise other materials having a high thermal conductivity a such as, for example, aluminum ($a \approx 89 \times 10^6$ $m^2/s$). Any suitable method for applying the highly thermally conductive layer 6 may be used such as, for example, electroplating or by metal spraying. It is also possible for suitable compounds, in particular metal compounds, having a high thermal conductivity a to be applied by flame spraying.

Figure 4A:
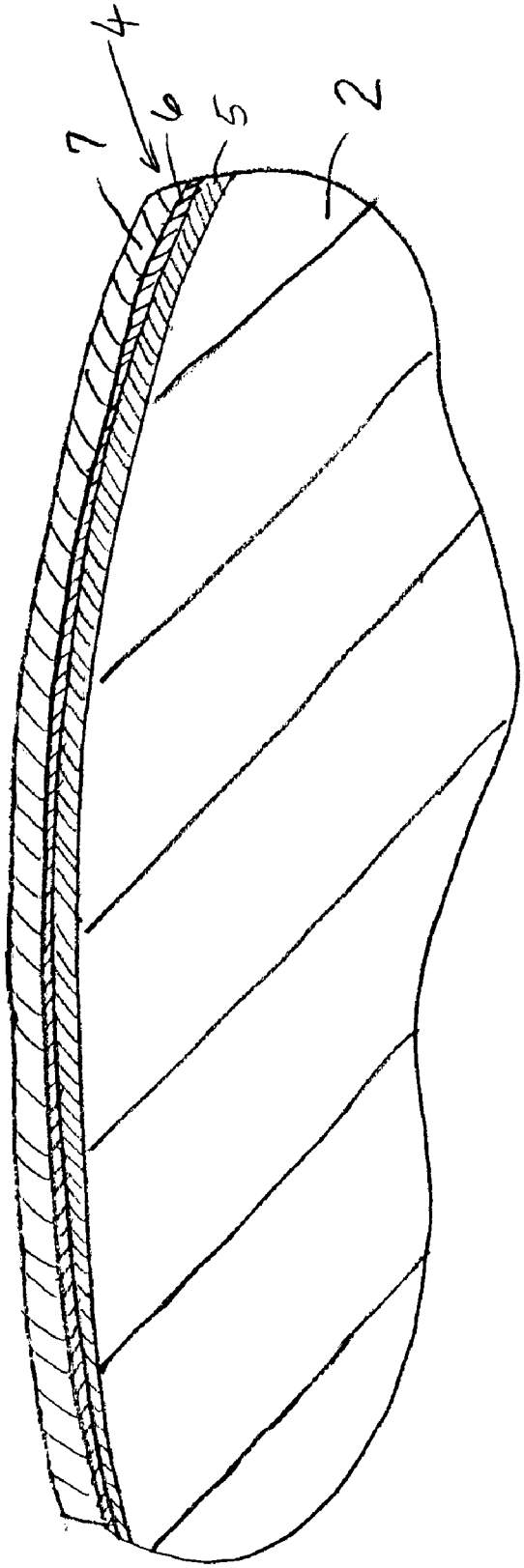
FIG. 4*a* is a transverse sectional view of the transfer cylinder of FIG. 4.
Figure 5:
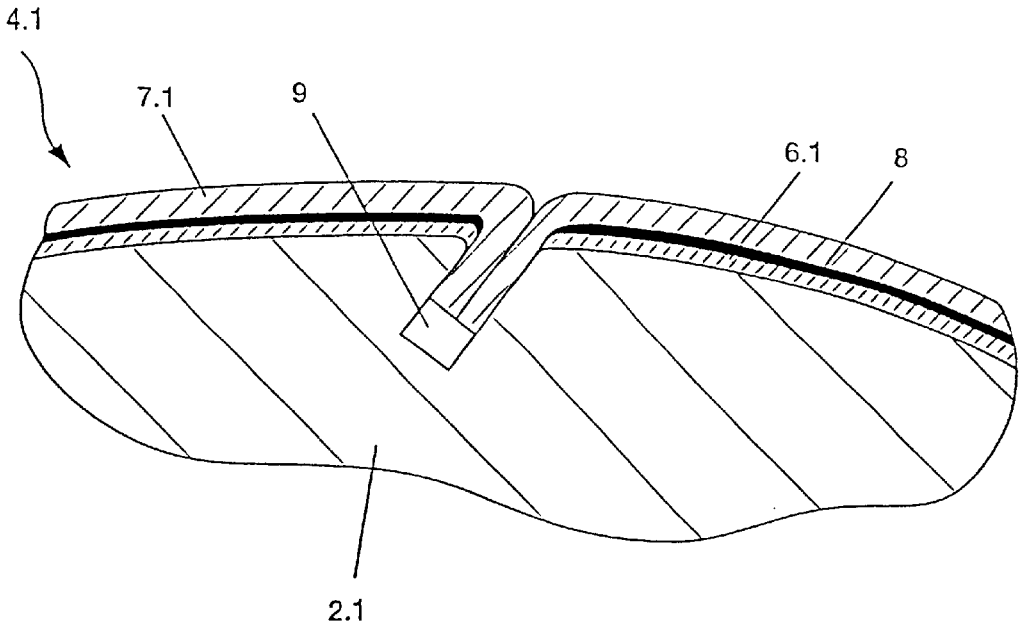
FIG. 5 is a tranverse sectional view of a transfer cylinder with a layer having a high thermal conductivity according to another embodiment of the present invention.

In FIG. 5, a transfer cylinder 2.1 is shown according to another embodiment which the transfer cylinder 2.1 itself serves as a support for a highly thermally conductive layer 6.1 which may, for example, comprise copper and is about 0.3 to 0.5 mm thick. The highly thermally conductive layer 6.1 may optionally be covered by a nickel wearing layer 8 a few hundredths of a millimeter thick, which also serves for corrosion prevention. By minimizing the thickness of the nickel wearing layer 8, corrosion prevention is achieved with only insignificant impairment of the desired heat distribution. A rubber blanket 7.1 may be, for example, clamped onto the transfer cylinder 2.1 by having its ends inserted into a clamping slot 9 in the transfer cylinder 2.1. The highly thermally conductive layer 6.1 (comprising, for example, a copper or an aluminum layer) allows the uniform temperature variation illustrated in FIG. 3 to be established. It is also possible for a supporting sleeve 5 bearing a rubber blanket 7 optionally having the highly thermally conductive layer 6 to be applied to the cylinder 2 as indicated in FIG. 4*a*. The highly thermally conductive layers 6 and 6.1 contribute to making the temperature variation uniform. If the clamping slot 9 is omitted, blow holes 17 as shown in FIG. 4 may then be provided.

Figure 6:
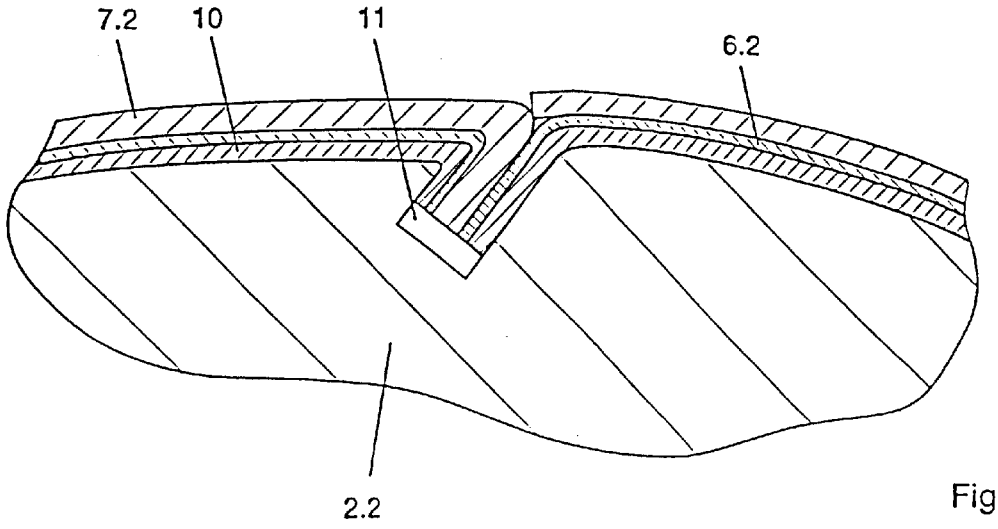
FIG. 6 is a transverse sectional view of a transfer cylinder having a rubber-blanket unit clamped thereon with a support having a thermally conductive layer according to yet another embodiment of the present invention.

According to FIG. 6, a rubber blanket 7.2 is fixed to a supporting plate 10 which may be clamped onto a transfer cylinder 2.2 via a clamping slot 11. A highly thermally conductive layer 6.2 comprising, for example, copper or aluminum, is provided on a surface of the supporting plate 10 facing the rubber blanket 7.3. The thermally conductive layer 6.3 facilitates distribution of local dissipation heat in the circumferential direction, as shown in FIG. 3. For the purpose of clamping, the supporting plate 10 is inserted with its turned-over legs into the clamping slot 11.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A rotary printing machine comprising a plate cylinder, a transfer cylinder, and an impression cylinder, said transfer cylinder being arranged between said plate cylinder and said impression cylinder for transferring an image to a web passing between said transfer-cylinder and said impression cylinder, a supporting sleeve inserted on said transfer cylinder, a multilayer rubber blanket arranged on said supporting sleeve, a highly thermally conductive layer fixedly arranged on an outer circumferential surface of said supporting sleeve, said highly thermally conductive layer comprising a material having a thermal conductivity (a) substantially higher than a thermal conductivity of steel so that locally developed heat on said rubber blanket is conducted and thereby distributed by said highly thermally conductive layer along a circumferential surface of the transfer cylinder, said transfer cylinder further comprising blow holes penetrating an outer surface of said transfer cylinder, said supporting sleeve being expandable by compressed air supplied through said blow holes for facilitating insertion of said supporting sleeve on said transfer cylinder and removal of said supporting sleeve from said transfer cylinder, and a thermally insulating layer arranged between said transfer cylinder and said supporting sleeve.

2. The rotary printing machine of claim 1, wherein said highly thermally conductive layer comprises a layer of an aluminum compound formed by flame spraying.

3. The rotary printing machine of claim 1, wherein said thermally insulating layer comprises an Astralon layer.

* * * * *